US011585540B2

(12) United States Patent
Lee et al.

(10) Patent No.: US 11,585,540 B2
(45) Date of Patent: Feb. 21, 2023

(54) COOKING DEVICE

(71) Applicant: LG Electronics Inc., Seoul (KR)

(72) Inventors: Yonghyun Lee, Seoul (KR); Jaekyung Yang, Seoul (KR); Semi Lee, Seoul (KR); Yongsoo Lee, Seoul (KR); Yoojin Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 89 days.

(21) Appl. No.: 17/040,442

(22) PCT Filed: Apr. 1, 2019

(86) PCT No.: PCT/KR2019/003772

§ 371 (c)(1),
(2) Date: Sep. 22, 2020

(87) PCT Pub. No.: WO2019/194483

PCT Pub. Date: Oct. 10, 2019

(65) Prior Publication Data

US 2021/0025596 A1 Jan. 28, 2021

(30) Foreign Application Priority Data

Apr. 3, 2018 (KR) ..... 10-2018-0038613

(51) Int. Cl.
*F24C 15/16* (2006.01)

(52) U.S. Cl.
CPC ..... *F24C 15/16* (2013.01)

(58) Field of Classification Search
None
See application file for complete search history.

(56) References Cited

U.S. PATENT DOCUMENTS

| | | | | |
|---|---|---|---|---|
| 1,872,733 | A * | 8/1932 | Greenwald | F24C 15/16 126/337 R |
| 3,145,289 | A * | 8/1964 | Swetlitz | F24C 15/08 126/39 M |
| 8,608,264 | B2 * | 12/2013 | Wing | F25D 25/02 312/408 |
| 2003/0020387 | A1 * | 1/2003 | Wing | F25D 25/02 108/108 |
| 2005/0204966 | A1 * | 9/2005 | Bienick | A47B 57/48 248/220.21 |
| 2006/0042522 | A1 * | 3/2006 | Trubiano | A47B 57/10 108/110 |
| 2008/0246382 | A1 * | 10/2008 | Kang | A47B 57/06 312/408 |

(Continued)

FOREIGN PATENT DOCUMENTS

| | | |
|---|---|---|
| KR | 100155499 | 7/1998 |
| KR | 1020020071527 | 9/2002 |

(Continued)

OTHER PUBLICATIONS

Notice of Allowance in Korean Appln. No. 10-2018-0038613, dated Jul. 25, 2022, 8 pages (with English translation).

*Primary Examiner* — Jorge A Pereiro
(74) *Attorney, Agent, or Firm* — Fish & Richardson P.C.

(57) ABSTRACT

A cooking device according to the present invention may comprise: a frame forming a cooking chamber; and a rack support mechanism detachably installed to the frame and supporting a rack such that height of the rack can be adjusted.

18 Claims, 11 Drawing Sheets

(56) References Cited

U.S. PATENT DOCUMENTS

| | | | | |
|---|---|---|---|---|
| 2009/0223505 | A1* | 9/2009 | Metcalf | F24C 15/16 126/339 |
| 2010/0000514 | A1* | 1/2010 | Baker | F24C 15/16 126/339 |
| 2010/0060124 | A1 | 3/2010 | Kang et al. | |
| 2010/0171402 | A1 | 7/2010 | Yoon | |
| 2012/0145141 | A1* | 6/2012 | Metcalf | F24C 15/16 126/339 |
| 2014/0231421 | A1 | 8/2014 | Yang et al. | |
| 2014/0238383 | A1* | 8/2014 | Armstrong | F24C 15/16 126/337 A |
| 2014/0252939 | A1* | 9/2014 | Tunzi | F25D 23/067 29/428 |

FOREIGN PATENT DOCUMENTS

| | | | | | |
|---|---|---|---|---|---|
| KR | 1020080045366 | | | 5/2008 | |
| KR | 1020080095552 | | | 10/2008 | |
| KR | 20110002589 | | | 1/2011 | |
| KR | 101174945 | | | 8/2012 | |
| KR | 1020140104514 | | | 8/2014 | |
| KR | 20180082040 | | | 7/2018 | |
| SU | 1632413 | A | * | 3/1991 | |
| WO | WO-2008062965 | A1 | * | 5/2008 | F25D 25/02 |
| WO | WO-2008078870 | A1 | * | 7/2008 | A47B 96/028 |
| WO | WO-2008130114 | A1 | * | 10/2008 | F25D 25/02 |
| WO | WO-2008130150 | A2 | * | 10/2008 | F25D 25/02 |
| WO | WO-2017137239 | A1 | * | 8/2017 | F25D 23/067 |
| WO | WO-2018202364 | A1 | * | 11/2018 | F25D 25/02 |

* cited by examiner

COOKING DEVICE

CROSS-REFERENCE TO RELATED APPLICATIONS

This application is a National Stage application under 35 U.S.C. § 371 of International Application No. PCT/KR2019/003772, filed on Apr. 1, 2019, which claims the benefit of Korean Patent Application No. 10-2018-0038613, filed on Apr. 3, 2018. The disclosures of the prior applications are incorporated by reference in their entirety.

TECHNICAL FIELD

The present disclosure relates to a cooking device.

BACKGROUND

A cooking device is a device that cooks food using heat from a heating source. The cooking device may include a frame configured to form a cooking chamber. A rack for supporting the food may be installed on the frame.

An apparatus for automatically adjusting the position of a cooking shelf for a gas oven range is disclosed in Korean Patent Publication No. 10-0155499, which is a prior document.

In the gas oven range of the prior document, a cooking shelf containing food is mounted on one side surface of the cavity. An output shaft of the drive motor is coupled to both ends of the cooking shelf through a towing line, so when the drive motor rotates, the towing line is wound around the output shaft of the drive motor or released from the output shaft to lift and lower the cooking shelf.

According to the prior document, since the cooking shelf has to be moved up and down in a state where the cooking shelf is installed in the cavity, holes extending in the up and down direction has to be formed on both side surfaces of the cavity.

Due to such a hole, heat in the cavity escapes to the outside of the cavity, so that cooking efficiency decreases, and it is difficult to take out the cooking shelf outside the cavity.

In addition, there is a problem in that food leftovers passes through the hole in the cooking process of food, and there is a disadvantage that it is difficult to clean the cavity due to the hole.

SUMMARY

The present disclosure provides a cooking device capable of adjusting the height of a rack while simplifying the structure of a frame configured to form a cooking chamber.

In addition, the present disclosure provides a cooking device capable of adjusting the height of the rack without taking the rack out of the cooking chamber.

In addition, the present disclosure provides a cooking device capable of easily cleaning the inside of a cooking chamber when the rack is taken out.

A cooking device according to an aspect may include a frame configured to form a cooking chamber, and a rack support device which is separably installed on the frame and supports the rack to be capable of adjusting the height of the rack.

The rack support device may include a guide member installed on the frame so that the height of the rack is adjusted in the cooking chamber, a rack supporter connected to the guide member so as to move up and down, and a rack seated on the rack supporter.

In a state where the height adjustment of the rack supporter is completed, so that the position of the rack supporter is fixed, the rack support device is provided on the rack supporter and moves together with the rack supporter, and may further include an adjustment device connected to the guide member at the position where the guide member is moved.

In order for the user to easily adjust the height of the rack, the rack supporter may further include a handle configured to be held by the user, and a lever which is disposed at a position adjacent to the handle and is configured to be operated by a user, and a transmission unit which is connected to the lever and is configured to transmit an operating force of the lever to the adjustment device.

In the present embodiment, the frame may include a fixing portion for separably fixing the guide member. In a state where the rack is seated on the rack supporter and the rack supporter is connected to the guide member, the guide member may be separated from the fixing portion.

For example, the cooking device may include a frame configured to form a cooking chamber, a guide member installed on the frame, a rack supporter connected to the guide member to move up and down, an adjustment device provided on the rack supporter, moving together with the rack supporter, and connected to the guide member at a position to which the rack supporter is moved, and a rack seated on the rack supporter.

The guide member may allow the rack supporter to move up and down and may include a plurality of guide rails which is spaced apart in a horizontal direction and a connection portion which connects the plurality of guide rails.

The adjustment device may be rotatably connected by a hinge at the rack supporter and may include a fixing protrusion which is provided at a position spaced apart from the hinge.

The guide rail may include a guide groove extending in an up and down direction, and a plurality of fixing grooves extending in a direction intersecting the guide groove at the guide groove and disposed to be spaced up and down.

The up and down movement of the adjustment device may be restricted in a state where the fixing protrusion is located in any one of the plurality of fixing grooves.

The rack supporter may be located in the guide rail through an opening of each guide rail, and the adjusting device may be located inside the guide rail in a state of being received in the rack supporter.

The opening may extend long in the up and down direction from each of the guide rails.

The rack supporter may further include a handle configured to be held by a user, a lever which is disposed at a position adjacent to the handle and is configured to be operated by a user, and a transmission unit connected to the lever to transmit operating force of the lever to the adjustment device.

The rack supporter may extend in a front and rear direction within the cooking chamber, and the handle may be located at a front end portion of the rack supporter. The adjusting device may be located at a rear end portion of the rack supporter.

The transmission unit may extend in a length direction of the rack supporter.

The lever may be rotatably connected to the rack supporter at the rear of the handle, and the rack supporter may further include a first elastic member configured to elastically support the lever.

The rack supporter may further include a second elastic member connecting the adjustment device and the transmission unit, and the second elastic member may be located on the opposite side of the fixing protrusion with respect to the hinge.

The rack supporter may further include a transmission unit supporter supporting the transmission unit.

The frame may include a fixing portion configured to separably fix the guide member. The guide member may be capable of being separated from the fixing portion in a state where the rack is seated on the rack supporter and the rack supporter is connected to the guide member.

The fixing portion may include a lower fixing portion supporting a lower side of the guide rail, and an upper fixing portion fixed to an upper side of the guide rail in a state where the guide rail is seated on the lower fixing portion.

The rack supporter may include a rack fixing portion configured to separably fix the rack.

According to the proposed embodiment, since the lower fixing portion is integrally formed on or coupled to the frame forming the cooking chamber and the upper fixing portion is coupled thereto, and thus a groove or protrusion for directly supporting the rack to the frame or a hole for movement of the rack is not formed on the frame, there is an advantage that the structure of the frame becomes simple.

In addition, since the rack supporter can move up and down with respect to the guide member in a state where the rack is supported by the rack supporter and, there is an advantage that the structure of the frame is simplified and the height of the rack can be adjusted.

In addition, since the rack supporter can move up and down with respect to the guide member in a state where the rack is supported by the rack supporter, the height of the rack can be adjusted without taking the rack out of the cooking chamber.

In addition, since the rack support device can be separated from the frame, it is possible to easily clean the cooking chamber in the frame in a state where the rack support device is separated from the frame.

DETAILED DESCRIPTION

Figure 1:
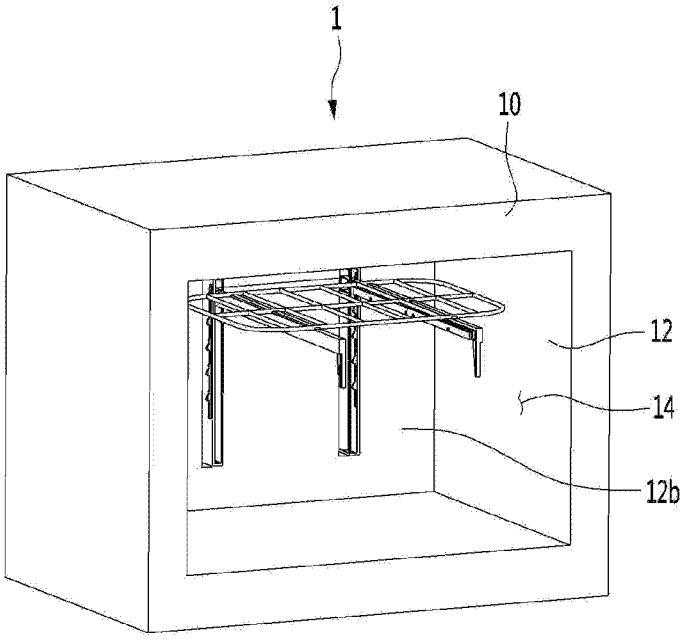
FIG. 1 is a view illustrating a cooking device according to an embodiment of the present disclosure.

Hereinafter, some embodiments of the present invention will be described in detail with reference to the accompanying drawings. Exemplary embodiments of the present invention will be described below in more detail with reference to the accompanying drawings. It is noted that the same or similar components in the drawings are designated by the same reference numerals as far as possible even if they are shown in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
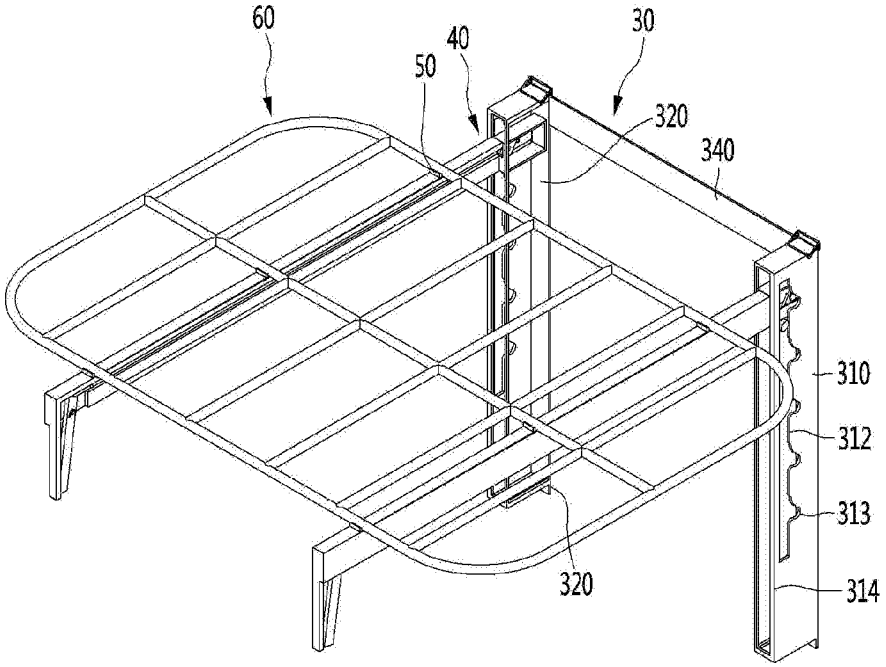
FIG. 2 is a perspective view illustrating a rack support device according to an embodiment of the present disclosure.

FIG. 1 is a view illustrating a cooking device according to an embodiment of the present disclosure, and FIG. 2 is a perspective view illustrating a rack support device according to an embodiment of the present disclosure.

Referring to FIGS. 1 and 2, the cooking device 1 according to the present embodiment may include a main body 10. The main body 10 may include a frame 12 forming the cooking chamber 14.

Although not illustrated, the main body 10 may include a heating source for heating the food received in the cooking chamber 14. In addition, the cooking chamber 14 may be opened and closed by a door.

A rack support device which supports a rack for supporting food may be disposed in the frame 12.

The rack support device may include a guide member 30 installed on the frame 12 and a rack supporter 40 movably connected to the guide member 30.

The guide member 30 may be installed on the rear wall 12*b* of the frame 12, for example.

The guide member 30 may include a plurality of guide rails 310 and 320 disposed to be spaced apart in a horizontal direction, and a connection portion 340 connecting the plurality of guide rails 310 and 320. The guide member 30 may include, for example, a pair of guide rails 310 and 320.

The connection portion 340 may connect the upper side portions of the side surfaces of the plurality of rails 310 and 320 between the plurality of rails 310 and 320, for example, but it should be noted that there is no limit to the position to which the connection portion 340 is connected and the number of the connection portion 340.

Each of the guide rails 310 and 320 may extend in the cooking chamber 14 in the up and down direction and may be disposed to be spaced apart from each other in a left and right direction.

The rack supporter 40 may be connected to each of the pair of guide rails 310 and 320. In other words, the rack support device may include a pair of rack supporters 40.

The rack supporter 40 may be connected to the guide rails 310 and 320 so as to move up and down. In other words, the height of the rack supporter 40 may be adjusted in the cooking chamber 14.

The guide rails 310 and 320 may include a guide groove 312 extending in the up and down direction, and a fixing groove 313 extending so as to intersect the guide groove 312 to enable the rack supporter 40 to move up and down.

A plurality of fixing grooves 313 may be disposed to be spaced apart in the up and down direction so that the height of the rack supporter 40 can be adjusted. Each of the fixing grooves 313 may extend from the guide groove 312 toward the rear wall 12*b* of the frame 12, for example.

In addition, an opening 324 may be formed in the guide rails 310 and 320 to enable the coupled rack supporter 40 to move up and down.

The opening 324 may extend long in the up and down direction, and the rack supporter 40 may be moved up and down within a height range of the opening 324.

The rack 60 may be seated on the upper side of the rack supporter 40. In a state where the rack 60 is seated on the rack supporter 40, the rack 60 may be moved up and down together by the up and down movement of the rack supporter 40.

The rack supporter 40 may include a rack fixing portion 50 for fixing the rack 60. The rack fixing portion 50 may be formed integrally with the rack supporter 40 or may be coupled to the rack supporter 40.

The rack 60 may be formed in a grid shape connecting a plurality of bars. In this case, the rack fixing portion 50 may include a pair of coupling hooks for coupling with some of the plurality of bars or may include a coupling groove for inserting some of the bars. In the present embodiment, it should be noted that there is no limit to the shape of the rack fixing portion 50.

Figure 3:
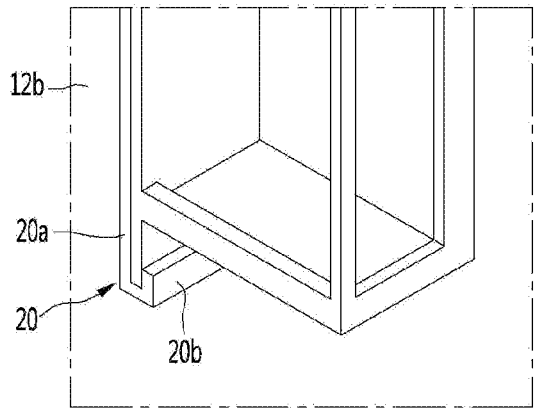
FIG. 3 is a view illustrating a lower fixing portion for fixing the guide member to the frame, according to an embodiment of the present disclosure.
Figure 4:
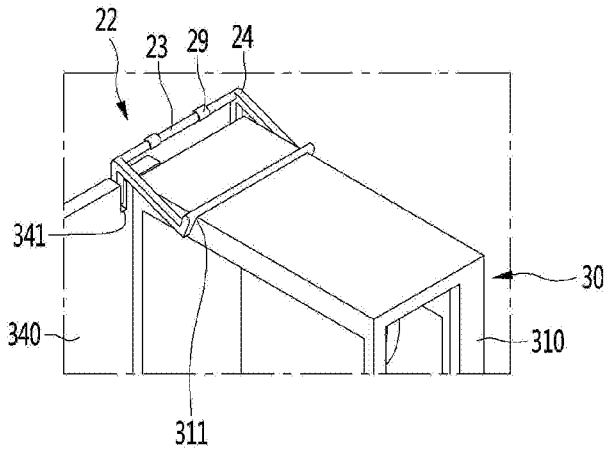
FIG. 4 is a view illustrating a state where an upper fixing portion for fixing a guide member to a frame is coupled to the guide member, according to an embodiment of the present disclosure.
Figure 5:
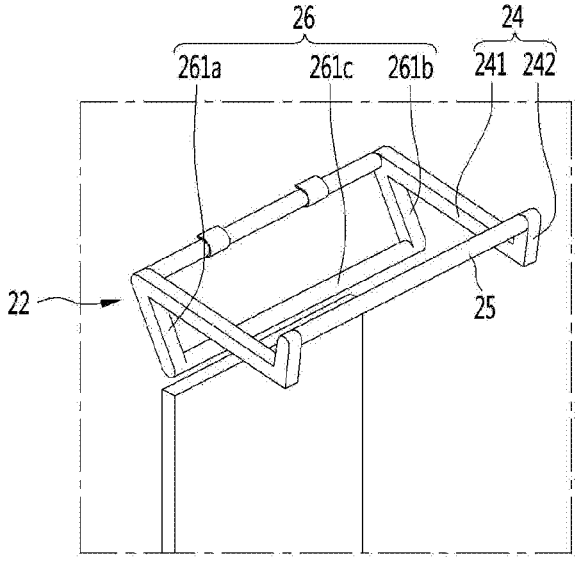
FIG. 5 is a perspective view illustrating an upper fixing portion according to an embodiment of the present disclosure.

FIG. 3 is a view illustrating a lower fixing portion for fixing the guide member to the frame, according to an embodiment of the present disclosure, FIG. 4 is a view illustrating a state where an upper fixing portion for fixing a guide member to a frame is coupled to the guide member, according to an embodiment of the present disclosure, and FIG. 5 is a perspective view illustrating an upper fixing portion according to an embodiment of the present disclosure.

First, referring to FIG. 3, a lower fixing portion 20 to which the lower side of the guide member 30 is fixed may be provided on the rear wall 12*b* of the frame 12. The lower fixing portion 20 may be integrally formed with the rear wall 12*b* of the frame 12 or may be coupled to the rear wall 12*b* of the frame 12.

The lower fixing portion 20 may include a frame contacting portion 20*a* contacting the frame 12, and a fixing rib 20*b* which extends from the frame contacting portion 20*a* and to which the guide rails 310 and 320 are fixed.

The fixing rib 20*b* may be formed in a shape such as "]", for example. Accordingly, the fixing rib 20*b* may support the lower side of the guide rails 310 and 320 and contact the front surface (a surface facing the door) of the guide rails 310 and 320.

Although not limited, the fixing rib 20*b* may form an insertion space, and some of the guide rails 310 and 320 may be inserted into the insertion space from the upper side of the fixing rib 20*b*.

Next, referring to FIGS. 4 and 5, the upper fixing portion 22 may be rotatably connected to the rear wall 12*b* of the frame 12.

The frame 12 may be provided with a rotation support portion 29 for rotatably supporting the upper fixing portion 22. The rotation support portion 29 may be formed integrally with the frame 12 or may be coupled to the frame 12.

The upper fixing portion 22 may fix the upper side of the guide rails 310 and 320 in a state where the guide rails 310 and 320 are fixed to the lower fixing portion 20.

The upper fixing portion 22 may include a shaft 23 connected to the rotation support portion 29, a pair of extension portions 24 extending from both end portions of the shaft 23, respectively, and a fixing bar 25 connecting the pair of extension portions 24.

Each of the extension portions 24 may include a first extension portion 241 and a second extension portion 242 extending from the first extension portion 241 to be inclined at a predetermined angle. In addition, the fixing bar 25 may connect end portions of the pair of second extension portions 242.

The distance between the pair of extension portions 24 may be larger than the left and right width of the guide rails 310 and 320.

A fixing groove 311 for receiving the fixing bar 25 may be formed at upper ends of the guide rails 310 and 320. When the fixing bar 25 is inserted into the fixing groove 311 by the rotation of the upper fixing portion 22, the pair of extension portions 24 may be located at the sides of the guide rails 310 and 320.

In other words, a portion of the guide rails 310 and 320 may be located between the pair of extension portions 24. Accordingly, it is possible to prevent the guide rails 310 and 330 from moving in the left and right direction by the pair of extension portions 24.

The upper fixing portion 22 may further include a rotation guide 26 for allowing the upper fixing portion 22 to rotate in a process in which the guide rails 310 and 320 are fixed.

The rotation guide 26 may include a pair of extension bars 261*a*, 261*b* extending from both ends of the shaft 23 and extending in a state of being inclined to the pair of extension portions 24 by a predetermined angle, and a connection bar 261*c* connecting the pair of extension bars 261*a*, 261*b*.

The rotation guide 26 may contact the rear surfaces of the guide rails 310 and 320 in a process in which the guide rails 310 and 320 are fixed.

At this time, before the fixing bar 25 is inserted into the fixing groove 311, the connection bar 261*c* of the rotation guide 26 may contact the rear surfaces of the guide rails 310 and 320.

When the guide rails 310 and 320 press the connection bar 261*c* toward the rear wall 12*b* of the frame 12, the upper fixing portion 22 may be rotated.

For example, the fixing bar 25 may be inserted into the fixing groove 311 by moving downward by the rotation of the upper fixing portion 22 in a state of being located above the guide rails 310 and 320.

In order to prevent the rotation guide 26 from interfering with the connection portion 340 in the process of fixing the guide rails 310 and 320, the connection portion 340 may have a slot 341 for receiving a portion of the rotation guide 26.

Hereinafter, a structure for up and down movement of the rack supporter 40 will be described in detail.

Figure 6:
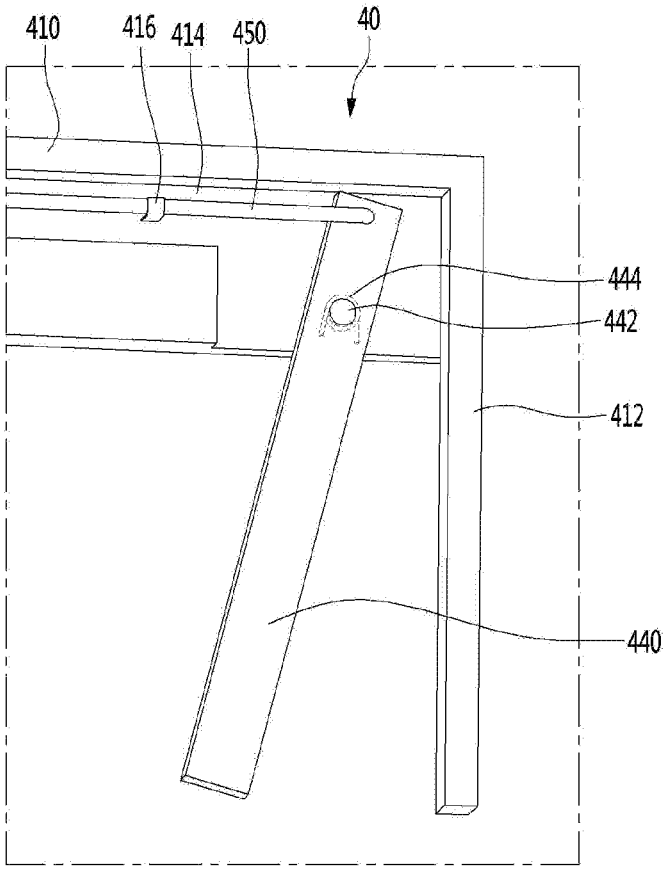
FIG. 6 is a view illustrating a rack supporter according to an embodiment of the present disclosure.
Figure 7:
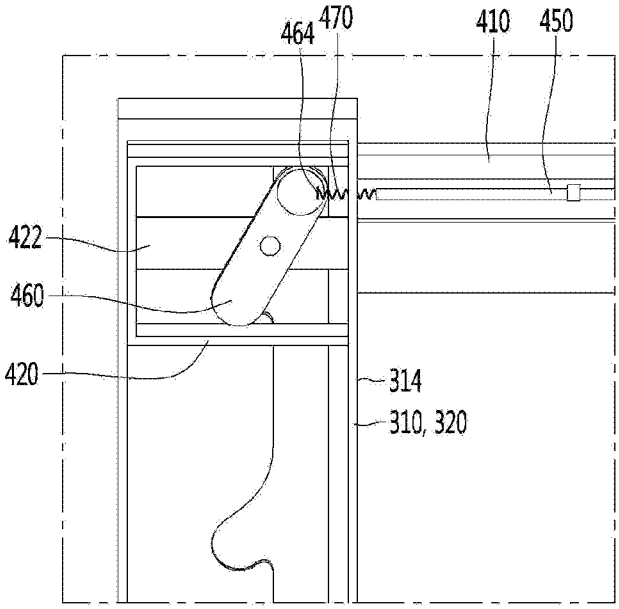
FIG. 7 is a view illustrating an adjustment device operating to adjust the height of the rack supporter.
Figure 8:
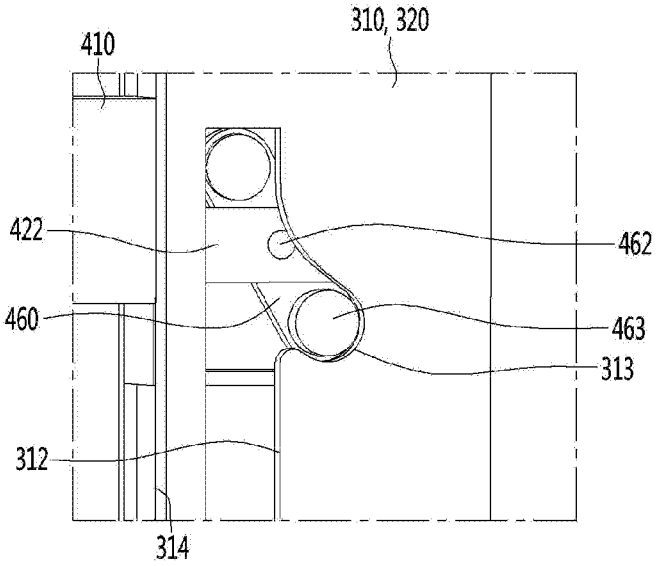
FIG. 8 is a view illustrating a state where the fixing protrusion of the adjustment device of FIG. 7 is inserted into the fixing groove of the guide rail.

FIG. 6 is a view illustrating a rack supporter according to an embodiment of the present disclosure, FIG. 7 is a view illustrating an adjustment device operating to adjust the height of the rack supporter, and FIG. 8 is a view illustrating a state where the fixing protrusion of the adjustment device of FIG. 7 is inserted into the fixing groove of the guide rail.

Figure 9:
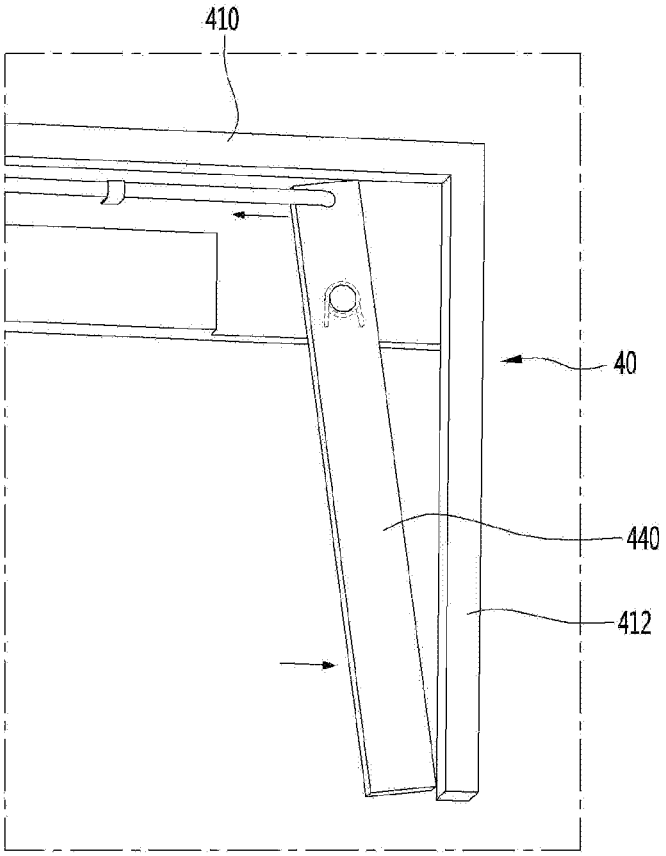
FIG. 9 is a view illustrating a state where the lever for height adjustment of the rack supporter is operated.
Figure 10:
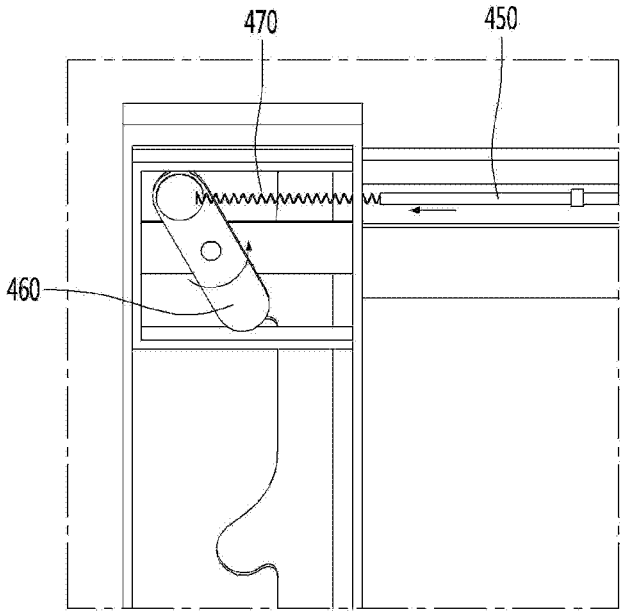
FIG. 10 is a view illustrating a state where the position of the adjustment device is changed by the operation of the lever.
Figure 11:
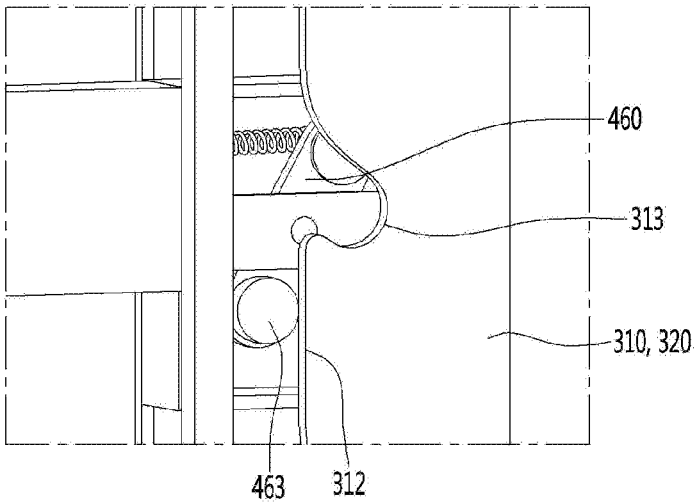
FIG. 11 is a view illustrating a state where the fixing protrusion of the adjustment device is located in the guide groove of the guide rail.

FIG. 9 is a view illustrating a state where the lever for height adjustment of the rack supporter is operated, FIG. 10 is a view illustrating a state where the position of the adjustment device is changed by the operation of the lever, and FIG. 11 is a view illustrating a state where the fixing protrusion of the adjustment device is located in the guide groove of the guide rail.

Referring to FIGS. 6 to 11, the rack supporter 40 may include a supporter body 410 having the form of a square frame.

The supporter body 410 may extend forward in a state of being connected to the guide rails 310 and 320.

A handle 412 that can be held by a user may be provided at a front end portion of the supporter body 410. The handle 412 may extend downward from the front end portion of the supporter body 410.

The rack supporter 40 may include a lever 440 operated by a user to adjust the height of the rack supporter 40, a transmission unit 450 for transmitting an operating force of the lever 440, and an adjustment device 460 that operates by receiving the operating force of the lever 440 from the transmission unit 450.

The lever 440 may be located behind the handle 412 in the supporter body 410. In other words, the handle 412 covers the lever 440 in front of the lever 440. In the present embodiment, the rear of the handle 412 is a direction toward the rear wall 12*b* of the frame 12.

Accordingly, it is possible to prevent the lever 440 from being exposed to the outside in a state where the door is open.

The lever 440 may be rotatably connected to the supporter body 410 by a hinge 442. The lever 440 may be located adjacent to the handle 412 so that the user can operate the lever 440 while holding the handle 412.

In addition, the lever 440 and the supporter body 410 may be connected by a first elastic member 444 so that the lever 440 may return to the original position of the lever after the lever 440 is operated. The first elastic member 444 may be a torsion spring, but is not limited thereto.

For example, the first elastic member 444 may be disposed in a state of being wound around the hinge 442. One end of the first elastic member 444 may be fixed to the lever 440 and the other end thereof may be fixed to the supporter body 410. Of course, the first elastic member 444 may be replaced with a coil spring or a leaf spring in addition to the torsion spring.

The transmission unit 450 may be connected to the lever 440 and may extend from the supporter body 410 in a front and rear direction. In other words, the transmission unit 450 may extend in the length direction of the rack supporter 40.

For example, the transmission unit 450 may be connected to the lever 440 so as to be capable of rotating relative to each other.

A receiving space 414 in which the transmission unit 450 and the lever 440 can be received may be formed in the supporter body 410 so that the transmission unit 450 and the lever 440 protrude to the outside of the supporter body 410 to the minimum.

For example, the receiving space 414 may be formed to be recessed in the supporter body 410.

In addition, a transmission unit supporter 416 for supporting the transmission unit 450 and preventing the transmission unit 450 from being separated from the supporter body 410 may be provided in the receiving portion 414. The transmission unit supporter 416 may be formed to surround at least a portion of the circumference of the transmission unit 450.

An adjustment device 460 may be disposed on the opposite side of the handle 412 on the supporter body 410. The supporter body 410 may further include an adjustment device receiving portion 420 for receiving the adjustment device 460.

The adjustment device receiving portion 420 may be inserted into the inner space of the guide rails 310 and 320 through the openings 314 of the guide rails 310 and 320.

The adjustment device 460 may be rotated by receiving the operating force of the lever 440 from the transmission unit 450.

To this end, the adjustment device 460 may include a hinge 462 for rotation. In addition, the hinge 462 may be located in the central portion of the adjustment device 460, for example.

A hinge support portion 422 rotatably supporting the hinge 462 may be provided in the adjustment device receiving portion 420.

The adjustment device 460 may include a fixing protrusion 463 disposed at a position spaced apart from the hinge 462.

The fixing protrusion 463 may protrude from a side of one end portion of the adjustment device 460, for example. The fixing protrusion 463 may have a rounded portion so that the fixing protrusion 463 can be smoothly inserted into the fixing groove 313. For example, the fixing protrusion 463 may be formed in a cylindrical shape.

A second elastic member 470 may be fixed to the opposite side of the fixing protrusion 463 with respect to the hinge 462 in the adjustment device 460.

The second elastic member 470 may be, for example, a coil spring, and a spring fixing portion 464 may be formed in the adjustment device 460. The spring fixing portion 464 may be, for example, a rib protruding from the adjustment device 460.

At this time, the fixing protrusion 463 may protrude from the first surface and the spring fixing portion 464 may protrude from the second surface among the first surface and the second surface of the adjustment device 460, which face each other.

The second elastic member 470 connects the adjustment device 460 and the transmission unit 450.

Unlike this, the transmission unit 450 is connected to the adjustment device 460 on the opposite side of the fixing protrusion with respect to the hinge 462, and the second elastic member 470 is also possible to connect the adjustment device 460 and the adjustment device receiving portion 420 at the opposite side of the transmission unit 450.

The second elastic member 470 may smoothly rotate the adjustment device 460 by the operating force of the lever 440.

In addition, the second elastic member 470 may provide an elastic force that causes the adjustment device 460 rotated by the operating force of the lever 440 to return to the original position thereof to the adjustment device 460.

For example, the spring fixing portion 464 may be located above the hinge 462 and the fixing protrusion 463 may be located below the hinge 462.

As illustrated in FIG. 8, in a state where the fixing protrusion 463 is inserted into the fixing groove 313, the position of the rack supporter 40 is fixed.

In this case, the elastic force of the first elastic member 442 may be set to be greater than the elastic force of the second elastic member 470.

As illustrated in FIG. 9, in order to adjust the height of the rack supporter 40, the user can operate the lever 440. For example, the user may pull the lever 440 in a process of holding the handle 412.

Then, as an example, the lower end of the lever 440 may be rotated in a direction closer to the handle 412 based on FIG. 9. In this case, the upper end of the lever 440 may be rotated in a direction away from the handle 412.

By the rotation of the lever 440, the transmission unit 450 is moved to the rear. When the transmission unit 450 moves backward, the fixing protrusion 463 is rotated in a direction which is separated from the fixing groove 313 by the transmission unit 450. When the fixing protrusion 463 is separated from the fixing groove 313 and moved to the guide groove 312, the rack supporter 40 can move up and down.

In this state, the user can move the rack supporter 40 upward or downward, and in a state where the height is determined, the operation of the lever 440 is released. Then, the lever 440 is returned to the original position thereof by the first elastic member 442, and the adjustment device 460 is rotated by the second elastic member 470, the fixing protrusion 463*b* is inserted into one of the plurality of fixing grooves 313, and thus the position of the rack supporter 40 is fixed.

According to the proposed embodiment, since the lower fixing portion is integrally formed or coupled with the frame forming the cooking chamber and thus the upper fixing portion is combined, a groove or protrusion for directly supporting the rack or a hole for movement of the rack is not formed on the frame, there is an advantage that the structure of the frame becomes simple.

In addition, since the rack supporter can move up and down with respect to the guide member in s state where the rack is supported by the rack supporter, there is an advantage that the structure of the frame is simplified and the height of the rack can be adjusted.

In addition, since the rack supporter can move up and down with respect to the guide member in a state where the rack is supported by the rack supporter, the height of the rack can be adjusted without taking the rack out of the cooking chamber.

In addition, since the rack support device can be separated from the frame, it is possible to easily clean the cooking chamber in the frame in a state where the rack support device is separated from the frame.

What is claimed is:

1. A cooking device comprising:

a frame configured to define a cooking chamber;

a guide member installed on the frame, the guide member comprising a guide rail that defines a plurality of fixing grooves;

a rack supporter connected to the guide member to move up and down, an adjustment device movably provided on the rack supporter and configured to be connected to the guide member at a position based on the rack supporter moving to the position; and a rack seated on the rack supporter, wherein the adjustment device comprises a fixing protrusion configured to insert into any one of the plurality of fixing grooves, and wherein the rack supporter comprises:

a lever, and a transmission unit connected to the lever and configured to transmit operating force of the lever to the adjustment device to thereby separate the fixing protrusion from one of the plurality of fixing grooves.

2. The cooking device of claim 1, wherein the guide member comprises:

a plurality of guide rails including the guide rail; and a connection portion that connects the plurality of guide rails.

3. The cooking device of claim 1, wherein the adjustment device is rotatably connected by a hinge at the rack supporter and includes the fixing protrusion, the fixing protrusion being provided at a position spaced apart from the hinge, wherein the guide rail further defines a guide groove extending in an up and down direction, and wherein the plurality of fixing grooves extend in a direction intersecting the guide groove and are spaced apart from each other in the up and down direction.

4. The cooking device of claim 3, wherein the fixing protrusion is configured to restrict an up and down movement of the adjustment device based on the fixing protrusion being located in any one of the plurality of fixing grooves.

5. The cooking device of claim 3, wherein the rack supporter is located in the guide rail and passes through an opening of the guide rail, and wherein the adjustment device is located inside the guide rail in a state of being received in the rack supporter.

6. The cooking device of claim 5, wherein the opening of the guide rail extends in the up and down direction.

7. The cooking device of claim 1, wherein the rack supporter further includes a handle disposed adjacent to the lever.

8. The cooking device of claim 7, wherein the rack supporter extends in a front and rear direction within the cooking chamber, wherein the handle is located at a front end portion of the rack supporter, and wherein the adjustment device is located at a rear end portion of the rack supporter.

9. The cooking device of claim 8, wherein the transmission unit extends in a longitudinal direction of the rack supporter.

10. The cooking device of claim 1, wherein the lever is rotatably connected to the rack supporter, and wherein the rack supporter further includes a first elastic member configured to elastically support the lever.

11. The cooking device of claim 10, wherein the rack supporter further includes a second elastic member connecting the adjustment device and the transmission unit, and wherein the second elastic member is located on an opposite side of the fixing protrusion with respect to a hinge that connects the adjustment device to the rack supporter.

12. The cooking device of claim 1, wherein the rack supporter further includes a transmission unit supporter supporting the transmission unit.

13. The cooking device of claim 1, wherein the frame includes a fixing portion configured to separably fix the guide member, and wherein the guide member is configured to be separated from the fixing portion in a state in which the rack is seated on the rack supporter and the rack supporter is connected to the guide member.

14. The cooking device of claim 13, wherein the fixing portion includes:

a lower fixing portion configured to support a lower side of the guide rail, and an upper fixing portion configured to be fixed to an upper side of the guide rail in a state in which the guide rail is seated on the lower fixing portion.

15. The cooking device of claim 1, wherein the rack supporter includes a rack fixing portion configured to separably fix the rack.

16. The cooking device of claim 1, wherein the lever is configured to receive the operating force from a user.

17. The cooking device of claim 1, wherein the rack supporter further includes a handle that is spaced apart from the lever and that faces the lever, the lever being configured to receive the operating force from a user based on the user moving the lever relative to the handle.

18. The cooking device of claim 1, wherein the transmission unit comprises a rod that extends in a front and rear direction within the cooking chamber, wherein the lever is connected to a front end portion of the rod, and wherein the adjustment device is connected to a rear end portion of the rod.

* * * * *